United States Patent [19]

Anderson et al.

[11] Patent Number: 4,869,869

[45] Date of Patent: Sep. 26, 1989

[54] METHOD OF CONSOLIDATING FENDB MAGNETS

[75] Inventors: Raymond L. Anderson, Redding; Joanna R. Groza; Brian Oslin, both of Carmichael, all of Calif.

[73] Assignee: Ceracon, Inc., Sacramento, Calif.

[21] Appl. No.: 249,116

[22] Filed: Sep. 26, 1988

Related U.S. Application Data

[63] Continuation of Ser. No. 99,321, Sep. 25, 1987, Pat. No. 4,808,224.

[51] Int. Cl.[4] ..... B22F 1/00

[52] U.S. Cl. ..... 419/44; 419/58; 419/49; 75/244; 75/246; 252/62.55

[58] Field of Search ..... 419/44, 49, 38; 75/244, 75/246; 252/62.55

[56] References Cited

U.S. PATENT DOCUMENTS 4,808,224 2/1989 Anderson et al. ..... 419/49

*Primary Examiner*—Stephen J. Lechert, Jr.

*Attorney, Agent, or Firm*—William W. Haefliger

[57] ABSTRACT

A method of treating a preform consisting essentially FeNeB alloy particles to produce a magnet having superior magnetic properties, the steps:

(a) removing $O_2$ from the preform and applying an $O_2$ resistant coating to the preform surface, or removing $O_2$ and maintaining an $O_2$-free environment, (b) heating the coated preform to elevated temperature and in a non-oxidizing atmosphere, to facilitate subsequent bonding of the particles during their consolidation, (c) providing a consolidation zone containing a grain bed and transferring the heated and coated or uncoated preform to said zone to be embedded in the grain bed, (d) applying pressure to the grain bed sufficient to be transferred via the bed and to the heated preform, thereby to consolidate the preform.

26 Claims, 2 Drawing Sheets

METHOD OF CONSOLIDATING FENDB MAGNETS

This is a continuation of application Ser. No. 099,321 filed Sept. 25, 1987, now U.S. Pat. No. 4,808,224.

This invention relates generally to production of magnetic material, and more particularly to improved processes for the production of magnets characterized by superior magnetic properties.

It is known that magnets made of an alloy of iron, neodymium and boron are characterized as having remarkably high coercivity as well as other improved magnetic properties. The particular alloy is based on the Fe-Nd-B family of rare earth transition metals materials, otherwise designated "FeNdB." These materials are manufactured using rapid solidification technology.

Such FeNdB magnets combine the highest known magnetic energy product with the high polarization coercitivity, $jH_c$. These parameters are the most important to characterize permanent magnet performance. In addition to this, Nd has a considerable price advantage, and fewer supply restrictions than samarium and/or cobalt, the latter being the main components of the established RE permanent magnets.

There are two basic technological processes used to prepare FeNdB magnets. One of these is a traditional PM approach consisting of alloy preparation, pre-milling, milling, control and adjustment of the composition, particle alignment and pressing, sintering and heat treatment. An alternate method of preparing FeNdB magnets is by using rapidly solidified (RS) materials. Larger coercive forces can be attained by melt-spinning of rare earth iron alloys due to the formation of a metastable phase and a very fine microstructure compared to a classically obtained powder.

The most simple approach of manufacturing melt-spun FeNdB ribbons preserving the characteristics gained by RS, is to compact them and glue the ribbon fragments together. The RS FeNdB alloy ribbon is crushed before blending with the glue (an epoxy resin). The reported maximum energy product $(BH)_{max}$ is 8 MGOe(63KJ/m$^3$) [3]. The theoretical maximum energy product for FeNdB materials is 64 MGOe(500 KJ/m$^3$). Hot pressing of crushed ribbons increases the maximum energy product to 13–15 MGOe (102–118 KJ/m$^3$). Next step deformation by die upsetting of hot pressed RS materials results in an anisotropic magnet with $(BH)_{max}$ of 20–40 MGOe (158–316 KJ/m$^3$). Milling of the RS melt-spun ribbons results in smaller particle size. The coercive force of ground powders decreases with decreasing particle size. This reduces coercitivity of the permanent magnets. [4].

All the above mentioned processes of consolidating RS materials involve crushing of RS powders. Besides melt-spun powders there are other methods to manufacture Rs FeNdB powders.

The high reactivity of the rare earths and their alloys, and the critical dependence of the magnetic properties in the chemical composition, require effective suppression of contamination during the powder metallurgical processing. In order to prevent oxidation of the melt-spun FeNdB alloy, an inert gas atmosphere is required in each step of powder milling or consolidation.

SUMMARY OF THE INVENTION

A major object of the present invention is to provide a process for consolidation of RS FeNdB powders that obviates the disadvantages and deficiencies of prior methods. This invention makes use of particles formed from melt-spun ribbon, or other RS powder materials, the particles formed into a green compact, and the consolidation of this compact, without sacrificing the RS microstructural features. The invention prevents oxidation of the RS magnetic powder without having to use costly atmosphere controlled chambers in the forging press. As coercitivity is controlled by the fine grained microstructure obtained by RS of FeNdB powder, it is essential to preserve this characteristic during consolidation of the powder. A short consolidation time at high temperature under high pressure exerted by carbonaceous or ceramic grain is critical in conserving the microstructural features of RS magnetic powders that guarantee high magnetic properties of the final product.

Basically, the invention involves the method of treating FeNdB alloy particles to produce a magnet having superior magnetic properties, and involves the steps (a) removing $O_2$ from the preform and applying an $O_2$ resistant coating to the preform surface, or removing $O_2$ from the pre-form and maintaining in an $O_2$ free environment, (b) heating the coated preform to elevated temperature and in non-oxidizing atmosphere, to facilitate subsequent bonding of the particles during their consolidation, (c) providing a consolidation zone containing a grain bed and transferring the heated and coated preform to said zone to be embedded in the grain bed, or transferring the preform in $O_2$ free environment to said grain bed, (d) applying pressure to the grain bed sufficient to be transferred via the bed to the heated preform thereby to consolidate the preform.

As will be seen, the method may include the initial step of forming the preform by pressurizing a mass of particles. Such pressurization may be carried out by locating said mass of particles within another unheated grain bed and pressurizing said other bed; or such pressurization may be carried out by providing a die having a cavity, locating the mass of particles in said cavity, and providing a plunger and displacing the plunger to pressurize the mass of particles. The process may include the step of initially displacing the particles to align them in generally the same direction. Vibration may be employed to so align the particles.

Regarding the coating step, the coating may advantageously consist of glass, as for example a glass frit in a liquid carrier vehicle; and the carrier may be removed as by vacuum application. The transfer step may be effected by transfer of the heated and coated preform to pass rapidly through an air environment; or the transfer may be effected through a non-oxidizing gaseous environment. The coating obviates need for an encompassing inert gas atmosphere surrounding both the heating areas and the pressure application area.

Pressurization of the heated preform is effected via a grain bed advantageously consisting of carbonaceous (such as graphite) or ceramic particles as will be seen. The applied pressure increase is at a "low" rate, that is, a rate that minimizes fracturing of the consolidated preform. Also, the pressure is allowed to dwell at a plateau level for a short time interval, after which the pressure is decreased at a "low" rate, the total pressurization interval typically being within about 120 seconds. In addition, a second pressurization may be advantageously effected, as will be seen.

These and other objects and advantages of the invention, as well as the details of an illustrative embodiment, will be more fully understood from the following specification and drawings, in which:

DRAWING DESCRIPTION

DETAILED DESCRIPTION

Figure 1:
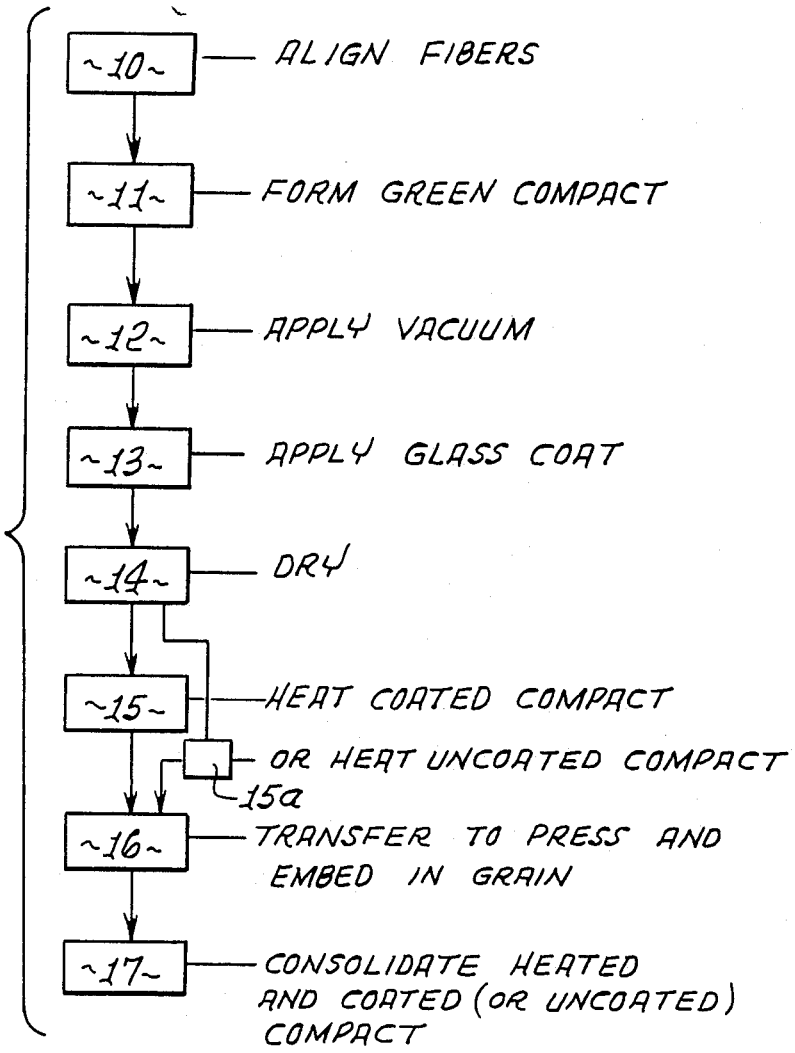
FIG. 1 is a flow diagram illustrating step of the process.

Referring to FIG. 1, it shows at 11 the initial cold-press formation of a "green" compact or preform, consisting of FeNdB alloy powder. The latter may be fibrous, ribbon-like or spherical in configuration with a size between 25–300 microns in diameter for example. Such particles are formed by various RS processes producing amorphous or micro-crystalline powder. RS particles may be initially vibrated at a rate and for a time interval to align them in generally the same direction, as associated at 10.

Figure 3:
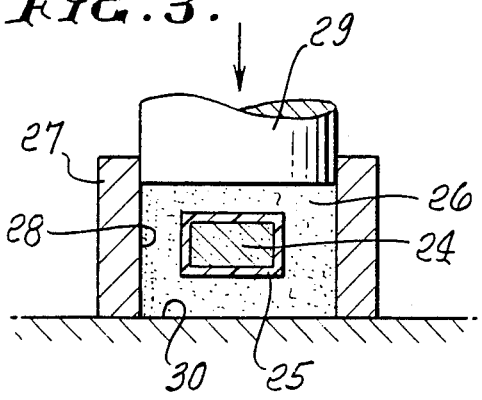
FIGS. 2 and 3 are elevations in section showing use of equipment for compacting pre-forms.
Figure 2:
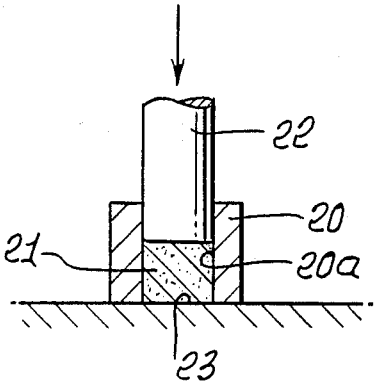

Pressures employed at step 11 are typically between 35 and 65 tons per square inch (TSI). FIG. 2 shows a die 20 having a bore 20*a* containing the mass 21 of particles which are being pressurized by a plunger 22, above a base 23, to form the compact. An alternative method is shown in FIG. 3, wherein the pre-form particles 24 are located within a flexible container 25 (elastomer, for example), embedded in a mass or bed 26 of grain particles. The latter are contained within a die 27 having a bore 28 receiving a plunger 29 for pressurizing the grain, above a fixed or a floatable base 30. The flowable grain transmits pressure to the mass of particles 24, via the container or jacket 25, to form the compact or preform. The grain may consist of carbonaceous or ceramic particles (see U.S. Pat. Nos. 4,539,175, 4,499,049 and 4,501,718, of size 50–240 mesh, and which are flowable. The texts of those patents are incorporated herein, by reference.

Next, the pre-form is de-gassed, as by a vacuum application step indicated at 12 in FIG. 1, thereby to remove oxygen, to prevent subsequent oxidation of the FeNdB particles at high temperature. A vitreous (glassy) coating is then applied to the preform, as indicated by step 13, under vacuum, as by dipping the green compact in a solution of glass frit in a carrier liquid such as isopropanol. One example is Deltaglaze 349 (a product of Acheson Colloids Company) diluted 1:2 or 1:3 in isopropanol, for about 1 minute, under vacuum. The subsequent step indicated at 14 comprises drying of the coating, as under vacuum of about $10^{-2}$ Torr, for about 2 hours. Carrier liquid is thereby removed, leaving a remanent coating of glass adherent to preform and completely covering same. The coating thickness is sufficient to adequately protect the sample from oxidation, typically less than 1 mm.

Subsequently, the glass or vitreous material encapsulated preform is heated, as in a furnace, in a nonoxidizing atmosphere, and for a time and at a temperature to facilitate subsequent bonding of the preform particles during consolidation under high pressure. Typically, the heating is continued for between 6–10 minutes, at a temperature or temperatures between 700° C. and 800° C. Heating time may be reduced using an inductance heater. See step 15 in FIG. 1. The furnace atmosphere may consist of Argon.

Figure 4:
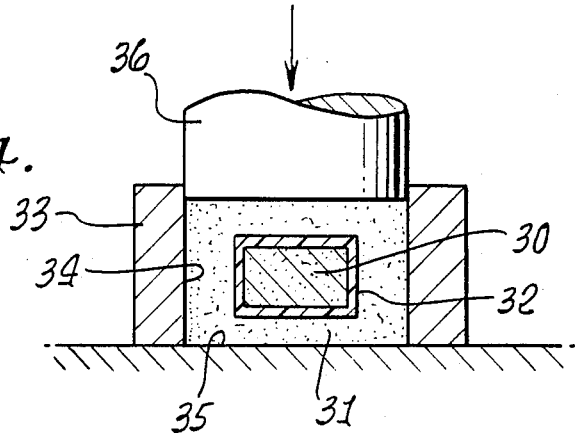
FIG. 4 is an elevation, in section, showing use of equipment for consolidating a preform having $O_2$ protective coating thereon.

Such treatment enables transfer of the coated and heated preform, as in air (see step 16) to a consolidation press, wherein the hot, glass coated preform 30 is embedded i a grain bed 31. The coating prevents external $O_2$ contact with the preform, during transfer. FIG. 4 shows these elements, the glass coating indicated at 32.

Alternately the transfer may be done in an $O_2$ free protection atmosphere. See Step 15*a* in FIG. 1.

The press includes a die 33 having a bore 34 containing the grain bed, above a base 35. A plunger 36 fits the bore and pressurizes the flowable grain, the latter transferring pressure to the preform t all sides thereon. The preform is reduced in size during consolidation. The consolidation step is indicated at 17 in FIG. 1.

The grain typically consists of flowable graphite particles which are fissured and have nodules thereon. See U.S. Pat. No. 4,539,175. Alternatively, ceramic particles can be employed to reduce heat loss from the heated preform, although graphite is preferred due to advantages described in U.S. Pat. No. 4,539,175. Mixtures of graphite and ceramic particles are usable. The grain temperature is desirably higher than that of the preform (25° C. to 350° C. higher) so as to maintain the preform at temperature between 700° C. and 800° C. during consolidation. Rapid consolidation is achieved by displacement of the plunger 36 toward and against the grain, indicated in FIG. 4.

The range of pressures used to consolidate FeNdB magnets is 5 to 85 TSI under low strain rate. The holding time under pressure is up to 120 seconds. By using conventional pressing equipment, the pressure available for consolidation is high enough for short consolidation cycle times. The short times at high temperatures result in very fine grain structures of the FeNdB magnets, this ultrafine structure guaranteeing high coercive forces and therefore high magnetic energy products, (up to 10 times higher than ferrite magnets).

Figure 5:
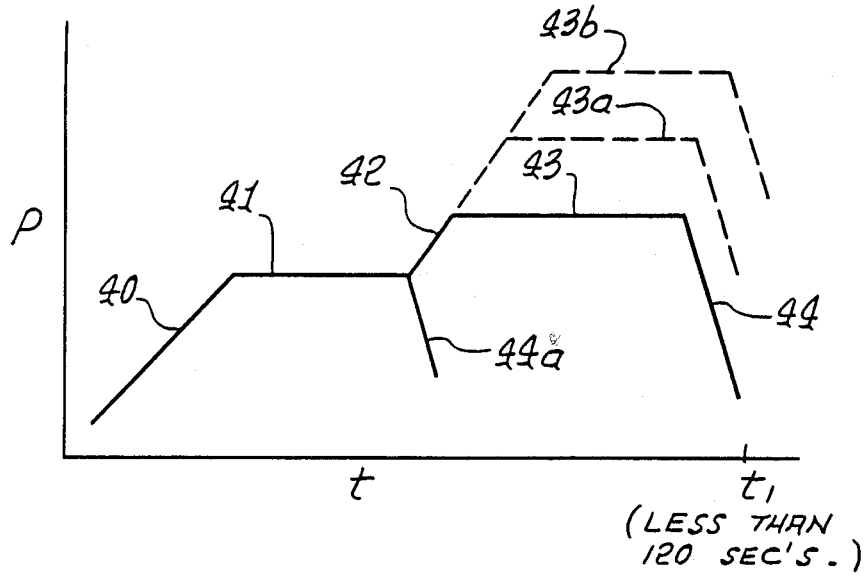
FIGS. 5 and 6 are consolidation pressure vs time diagrams.

FIG. 5 shows low rate of pressure increase at 40 to a level 41, typically about 10 TSI. That rate is such that the consolidated magnet does not easily fracture, and is typically between 0.15 TSI/sec. and 0.35 TSI/sec. and more generally between 0.1 and 0.7 TSI/sec. The pressure is held at dwell level 41 for between 15 and 60 seconds, and could subsequently increased at 42 to a second dwell level 43. That dwell level is typically about 10 TSI, although alternative dwell levels at 43*a* and 43*b* could be 20 TSI and 35 TSI, respectively. The pressure is maintained at the second dwell level for between 15 and 60 seconds, and then allowed to drop to zero, as indicated at 44. Alternatively to increasing pressure on line 42 is to decrease pressure to zero as shown in FIG. 5, 44*a*, with no subsequent pressure application.

Figure 6:
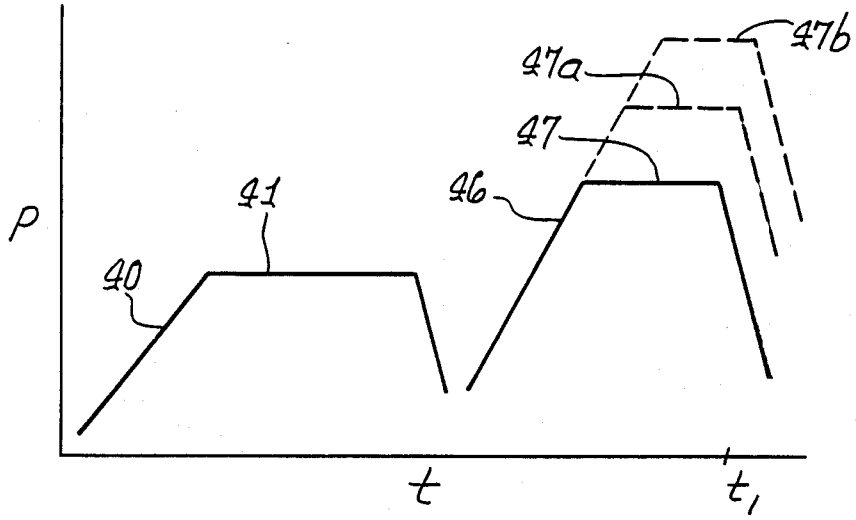

FIG. 6 shows another alternative technique of applying a second pressure cycle. Pressure applications 40 and 41 are the same as in FIG. 4. After dwell interval 41, pressure is allowed to drop to zero, and steps 13–16 are then repeated. The heated and re-coated preform is then subjected to a second pressure application, as indicated at 47, and at a rate as described above in FIG. 4. Level 47 is for example about 15 TSI, and alternative levels 47*a* and 47*b* are indicated at 20 TSI and 35 TSI. The durations of levels 47, 47*a* and 47*b* are between 15 and 60 seconds, after which the pressure is allowed to drop to zero.

EXAMPLE

Use was made of a rapidly solidified ribbon-like powder produced by melt-spinning techniques, and supplied by Marko Materials, Inc. The powder composition comprised Fe, Nd, B, with minor additions of by weight Co, Al, and Si to improve physical properties. No crushing was applied to the as-spun melt powder. In order to cold press these long fibers of a very brittle material, a vibration alignment of the powders was necessary. After vibration packing, the powder was cold pressed in a hard die at 52.5 TSI, and at room temperature.

An alternative for cold pressing in a hard die is a quasi-isostatic cold pressing in graphite as a pressure-transmitting medium. (See FIG. 3). The powder was encapsulated in a rubber mold and placed inside the grain filled die. The die was then transferred into the hydraulic press and the ram compressed the grain at a pressure of 50 TSI.

The green compacts, either cold-pressed in the hard die or in a grain bed, were then coated with Deltaglaze 340 diluted 1:(2 to 3) in ispropanol. The coating was applied by dipping the green compact in the Deltaglaze solution for about 1 minute under vacuum. The drying was carried out under vacuum of $10^{-2}$ Torr for about 2 hours. This coating proved to be a viable method of preventing oxidation of the NdFeB powder during the transfer of the sample from the heating furnace to the die.

The coated preforms were heated for 6 to 10 minutes in a tubular furnace under Argon atmosphere. Normally the $O_2$ content of the Argon was below 30 ppm. The heating temperature range was 700° to 800° C. The heated preform was quickly transferred in air to the grain filled die and completely embedded in the bed of heated carbonaceous particles by a robot. The grain temperature was 25° to 225° C. higher than the preform temperature. The embedded preform was compressed under high uniaxial pressure by the action of a ram in the die, with dual pressure application as in FIG. 5. The complete reference to the Ceracon process is to be found elsewhere [5.,6].

For the preforms cold pressed in a grain bed (Ceracon cold isotatic pressing) using crushed powders, the consolidating pressure was 85 TSI at 750° C.

The process of the invention is also applicable to:

(a) magnetic material powder alloys other than FeNdB;

(b) preform powder that is highly oxidizing, to protect the preform during transfer and consolidation;

(c) preform powder that requires physical protection to maintain preform shape, during the transfer and consolidation process.

REFERENCES

1. J. Ormerod, "Processing and Physical Metallurgy of NeFe B and other R.E. Magnets", in "NdFe permanent Magnets: Their present and Future Applications", Elsevier Appl Sci Pub, London and New York p. 69–92.
2. K. H. J. Bushcow, "New Permanent Magnet Materials", Mat Sci Rep 1, 1–64, 1986 North-Holland, Amsterdam.
3. D. Hadfield, "Perspective and Prospective Overview of Rare-Earth Transition Metal - Metalloid Permanent Magnets", Met Powder Rep., 42, 420–425 (1987).
4. C. R. Paik, H. Miho, M. Okada, M. Homma, "Improvements of Coercive Force in Ce-Didymium-Fe-B Powders Prepared by Conventional Powder Techniques", 1987 Digest of Intermag '87, Intern Magnetics Conf, April 14–17, Tokyo, Japan GG03.
05. W. P. Lichti, A. F. Hofstatter, "Method of Object Consolidation Employing Graphite Particulate", U.S. Pat. No. 4,640,711, Feb. 3, 1987.
6. F. G. Hanejko, "Method of Consolidating a Metallic or Ceramic Body", U.S. Pat. No. 4,499,049, Feb. 12, 1985.

We claim:

1. In the method of treating a preform consisting essentially of FeNdB alloy particles to produce a magnet having superior magnetic properties, the steps that include:

(a) removing $O_2$ from the preform and applying an $O_2$ resistant coating to the preform surface, (b) heating the coated preform to elevated temperature and in a non-oxidizing atmosphere, to facilitate subsequent bonding to the particles during their consolidation, (c) providing a consolidation zone containing a grain bed and transferring the heated and coated preform to said zone to be embedded in the grain bed, (d) applying pressure to the grain bed sufficient to be transferred via the bed and to the heated preform, thereby to consolidate the preform, said application of pressure to the grain bed carried out to increase to at least one level and at rate that minimizes fracturing of the consolidated preform, said application of pressure held at said dwell level for at least several seconds and at a level of at least about 10 TSI.

2. The method of claim 1 including the initial step of forming said preform by pressurizing a mass of the particles.

3. The method of claim 2 wherein said pressurizing of the particles is carried out by locating said mass of the particles within another grain bed and pressurizing said other bed.

4. The method of claim 2 wherein said pressurizing of the particles is carried out by providing a die having a cavity, locating said mass of the particles in said cavity, and providing a plunger and displacing the plunger to pressurize said mass of particles.

5. The method of claim 2 including the step of initially displacing the particles to align them in generally the same direction.

6. The method of claim 5 wherein said displacing of the particles is effected by vibrating them.

7. The method of claim 1 wherein said coating consists of glass.

8. The method of claim 1 wherein said coating consists of glass frit in a liquid carrier vehicle, and including the step of removing the liquid carrier vehicle from the coating by vacuum application.

9. The method of claim 8 wherein said heating of the glass coated preform is carried out at a temperature of between about 700° C. and 800° C.

10. The method of claim 9 wherein said heating is contained for between about 6 to 10 minutes.

11. The method of one of claims 9 wherein said heating is effected by magnetic induction.

12. The method of claim 1 wherein said transfer of the heated and coated preform is carried out rapidly to pass through an air environment.

13. The method of claim 1 wherein said grain bed consists essentially of carbonaceous grain particles.

14. The method of claim 13 wherein said carbonaceous particles are resiliently compressible.

15. The method of claim 13 wherein said carbonaceous particles consist of graphite.

16. The method of claim 13 wherein said carbonaceous particles are fissured.

17. The method of claim 1 wherein said rate is between 0.1 and 0.7 TSI/sec.

18. The method of claim 1 wherein the bed consists essentially of ceramic grain particles.

19. The method of claim 1 wherein the bed consists of both ceramic and carbonaceous grain particles.

20. The method of claim 1 wherein application of pressure is held at a first dwell level up to 120 seconds.

21. The method of claim 1 including:

(i) reducing said pressure application, at the end of a dwell interval at said dwell level, (ii) and again performing (a'), (b'), (c') and (d') steps corresponding to said (a), (b), (c) and (d) steps, upon the same preform.

22. In the method of treating a preform consisting of metallic alloy particles subject to rapid oxidation, the steps that includes:

(a) removing $O_2$ from the preform and applying an $O_2$ resistant coating to the preform surface, (b) heating the coated preform to elevated temperature and in a non-oxidizing atmosphere, to facilitate subsequent bonding of the particles during their consolidation, (c) providing a consolidation zone containing a graphite grain bed and transferring the heated and coated preform to said zone to be embedded in the grain bed, (d) applying pressure to the grain bed sufficient to be transferred via the bed to the heated preform, thereby to consolidate the preform, said application of pressure to the grain bed carried out to increase to a dwell level at a rate that minimizes fracturing of the consolidated preform, said application of pressure held at said swell level for at least several seconds and at a level of at least about 10 TSI.

23. In the method of treating a preform consisting of alloy particles, the steps that include:

(a) applying a vitreous coating to the preform surface, (b) heating the coated preform to facilitate subsequent bonding of the particles during their consolidation, (c) providing a consolidation zone containing a graphite grain bed and transferring the heated and coated preform to said zone to embedded in the grain bed, (d) applying pressure to the grain bed sufficient to be transferred via the bed and coating to the heated preform, thereby to consolidate the preform, said application of pressure to the grain bed carried out to increase to a dwell level at a rate that minimizes fracturing of the consolidated preform, said application of pressure held at said dwell level for at least several seconds and at a level of at least about 10 TSI.

24. The method of claim 23 wherein said coating consists of glass frit in a liquid carrier vehicle.

25. In the method of treating a preform consisting essentially of FeNdB alloy particles to produce a magnet having superior magnetic properties, the steps that include:

(a) maintaining an $O_2$ -free environment at the preform, (b) heating the preform to elevated temperature and in a non-oxidizing atmosphere, to facilitate subsequent bonding of the particles during their consolidation, (c) providing a consolidation zone containing a grain bed and transferring the heated preform to said zone to be embedded in the grain bed, (d) applying pressure to the grain bed sufficient to be transferred via the bed and to the heated preform, thereby to consolidate the preform, said application of pressure to the grain bed carried out to increase to a dwell level or levels at a rate that minimizes fracturing of the consolidated preform, said application of pressure held at said dwell level for at least several seconds and at different pressures exceeding about 10 TSI.

26. In the method of treating a preform consisting of metallic alloy particles subject to rapid oxidation, the steps that include:

(a) maintaining an $O_2$ free environment at the preform, (b) heating the preform to elevated temperature and in a non-oxidizing atmosphere, to facilitate subsequent bonding of the particles during their consolidation, (c) providing a consolidation zone containing a grain bed and transferring the heated preform to said zone to be embedded in the grain bed, (d) applying pressure to the grain bed sufficient to be transferred via the bed to the heated preform, thereby to consolidate the preform, said application of pressure to the grain bed carried out to increase to a dwell level or levels at a rate that minimizes fracturing of the consolidated preform, said application of pressure held at said dwell level for at least several seconds and at different pressures exceeding about 10 TSI.

* * * * *